United States Patent [19]

Oshiage et al.

[11] Patent Number: 4,565,173

[45] Date of Patent: Jan. 21, 1986

[54] METHOD AND SYSTEM FOR CONTROLLING FUEL TO BE SUPPLIED FROM FUEL PUMP TO ENGINE

[75] Inventors: Katsunori Oshiage, Yokosuka; Akio Hosaka, Yokohama, both of Japan

[73] Assignee: Nissan Motor Company, Limited, Yokohama, Japan

[21] Appl. No.: 333,011

[22] Filed: Dec. 21, 1981

[30] Foreign Application Priority Data

Dec. 26, 1980 [JP] Japan ..... 55-184107

[51] Int. Cl.[4] ..... F02M 39/00

[52] U.S. Cl. ..... 123/458; 123/357

[58] Field of Search ..... 123/458, 357, 478, 490, 123/492, 358, 359

[56] References Cited

U.S. PATENT DOCUMENTS

| | | | |
|---|---|---|---|
| 3,699,931 | 10/1972 | Cinquegrani | 123/458 |
| 3,827,409 | 8/1974 | O'Neill | 123/458 |
| 3,949,713 | 4/1976 | Rivere | 123/458 |
| 4,173,030 | 10/1979 | Rabe | 123/490 |
| 4,321,901 | 3/1982 | Kobayashi | 123/357 |

FOREIGN PATENT DOCUMENTS

| | | | |
|---|---|---|---|
| 2044519 | 2/1971 | France | 123/458 |
| 2144407 | 2/1973 | France | 123/458 |

OTHER PUBLICATIONS

2244 Research Disclosure No. 166 (Feb. 1978), "Engine Control Computer"-16666.

*Primary Examiner*—Carl Stuart Miller

*Attorney, Agent, or Firm*—Schwartz, Jeffery, Schwaab, Mack, Blumenthal & Evans

[57] ABSTRACT

A method and apparatus for controlling fuel to be supplied from a motor-driven fuel pump to fuel injection valves of a fuel injected engine, the time period during which the fuel injection valves are kept open and the power duty cycle for driving the fuel pump motor are both calculated by a microcomputer responsive to one or more engine operating conditions. Reduced power consumption of the pump motor is achieved, thus resulting in reduction in the load applied to the battery and therefore improving the fuel consumption rate. The apparatus comprises an input unit, an injector drive unit, and a pump drive unit in addition to the microcomputer, and includes circuits for converting both the time period and the power duty cycle according to the battery voltage and the degree of engine acceleration.

2 Claims, 11 Drawing Figures

METHOD AND SYSTEM FOR CONTROLLING FUEL TO BE SUPPLIED FROM FUEL PUMP TO ENGINE

FIELD OF THE INVENTION

The present invention relates to a method and a system for controlling fuel to be supplied from a motor-driven fuel pump to fuel injection valves for an engine, and more specifically to a method and system for controlling the time period during which the fuel injection valves are kept open and the power by which the motor to drive the fuel pump is driven, according to the engine operating conditions.

DESCRIPTION OF THE PRIOR ART

Fuel pumps used for supplying fuel from a fuel tank to fuel injection valves for an engine are generally of two types: a fuel pump of engine-driven type in which the pump is directly driven by the power of the engine and a fuel pump of motor-driven type in which the pump is driven by a separate motor.

In the prior-art fuel control system used for the above-mentioned fuel pump of motor-driven type, the difference of the pressure of fuel to be supplied from a fuel pump to fuel injection valves and the intake manifold pressure to which the fuel is injected is always kept at a predetermined constant level, and a predetermined amount of fuel is injected through the fuel injection valves when a fuel supply signal is applied to the fuel injection valves according to engine operating conditions.

In such a prior-art fuel control system for a motor-driven type of a fuel pump, however, the fuel pump is continuously driven by the motor, while the engine is running, in order to maintain the fuel pressure to be applied to the fuel injection valves at a predetermined level so that said pressure differences can be constant, and when the fuel pressure from the fuel pump rises beyond a predetermined pressure, some fuel at excessive pressure is returned to the fuel tank.

In this case, there exist various problems. For example, the current consumption due to the motor is inevitably great, a large load is always applied to the vehicle battery and thus the alternator, and therefore, the fuel consumption efficiency decreases.

A more detailed description of the prior-art fuel control system used for the fuel pump of motor-driven type will be made hereinafter with reference to the attached drawing under DETAILED DESCRIPTION OF THE PREFERRED EMBODIMENTS.

SUMMARY OF THE INVENTION

With these problems in mind therefore, it is the primary object of the present invention to provide a method and a system for controlling fuel quantity and pressure to be supplied from a fuel pump to fuel injection valves for an engine whereby it is possible to reduce the power consumption of the motor to drive the fuel pump, reduce the load applied to the battery and alternator, and thus improve the fuel consumption efficiency.

To achieve the above mentioned objects, the method for controlling fuel to be supplied from the motor-driven fuel pump to the fuel injection valves according to the present invention comprises steps by which the level of fuel pressure to be generated by the fuel pump and the amount of fuel to be injected through the fuel injection valves (proportional to the period of time for which the injection valve is kept open) are simultaneously controlled according to the engine operating conditions. In this case, the level of fuel pressure to be generated by the fuel pump is controlled by changing the duty cycle of the power applied to the motor to drive the fuel pump, and the amount of fuel to be injected through the fuel injection valve into the engine is controlled by changing the pulse-width of the signal to open the injection valve.

To achieve the above mentioned objects, the system for controlling fuel to be supplied from the motor-driven fuel pump to the fuel injection valves according to the present invention comprises a pulse input unit, an injector drive unit, and a pump drive unit, in conjunction with a microcomputer having a CPU, a ROM, a RAM, a clock, etc.

BRIEF DESCRIPTION OF THE DRAWINGS

The features and advantages of the method and system for controlling fuel to be supplied from a motor-driven fuel pump to fuel injection valves according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

To facilitate understanding of the present invention, a brief reference will be made to a prior-art system for controlling fuel to be supplied from a fuel pump driven by a motor to fuel injection valves with reference to FIG. 1.

Figure 1:
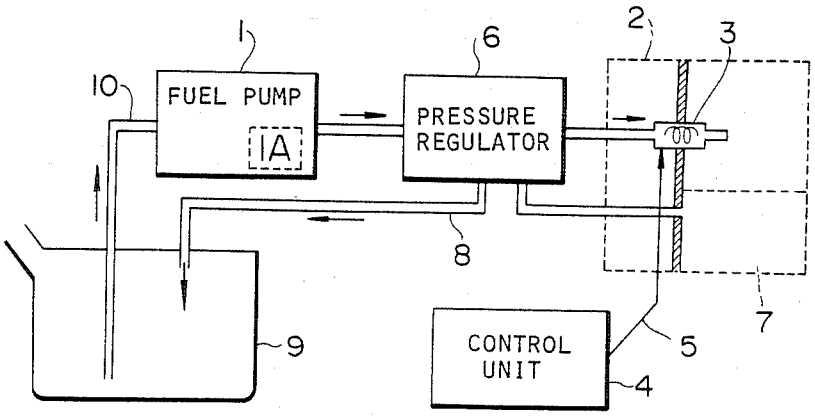
FIG.1 PRIOR ART
FIG. 1 is schematic block diagram of a sample prior art system for controlling fuel to be supplied from a motor-driven fuel pump to fuel injection valves for an engine.

FIG. 1 shows a sample prior-art system for controlling fuel to be supplied to an engine which uses a motor-driven fuel pump. Here, the reference numeral 1 denotes a motor-driven fuel pump; the numeral 1A denotes the pump motor; the numeral 2 denotes an engine; the numeral 3 denotes a fuel injection valve mounted on the engine 2; and the numeral 4 denotes a control unit. A fuel supply signal is applied from the control unit 4 to the fuel injection valve 3 through a signal wire 5 according to the engine operating condition, so that the appropriate amount of fuel is supplied to the engine through the fuel injection valve 3 in accordance with the signal.

The reference numeral 6 denotes a pressure regulator disposed between the fuel pump 1 and the fuel injection valve 3. The pressure regulator 6 is so constructed that the difference in pressure between the fuel pressure supplied to the fuel injection valve 3 and the pressure within an intake manifold 7 of the engine 2 can be maintained at a predetermined constant level. Thus, when the pressure of fuel generated by the fuel pump 1 rises and the pressure difference exceeds the predetermined level, the fuel is returned back from the pressure regulator 6 to a fuel tank 9 through a return pipe 8. The reference numeral 10 denotes an intake pipe to supply fuel from the fuel tank 9 to the fuel pump 1.

In the fuel control system thus constructed, since the pressure of the fuel to be supplied from the fuel pump 1 to the fuel injection valve 3 is always kept at a constant level with respect to the intake manifold pressure, when a fuel supply pulse signal corresponding to the engine operating conditions is applied to the fuel injection valve 3, a predetermined amount of fuel is injected into the intake manifold through the fuel injection valve 3 in accordance with the signal pulse-width.

In such a prior-art fuel control system for an engine comprising a motor-driven fuel pump 1, however, in order to maintain the pressure of the fuel supplied to the fuel injection valve 3 at the constant level with respect to the intake manifold pressure, the fuel pump 1 is continuously driven by the motor while the engine 2 is running, and when the pressure of the fuel from the fuel pump 1 with respect to the intake manifold pressure rises beyond the constant level, some fuel at excessive pressure returns to the fuel tank 9. Therefore, there exist various problems, for example, the current consumption is inevitably large, a large load is always applied to the battery and the alternator, and therefore the fuel consumption efficiency decreases.

Figure 2:
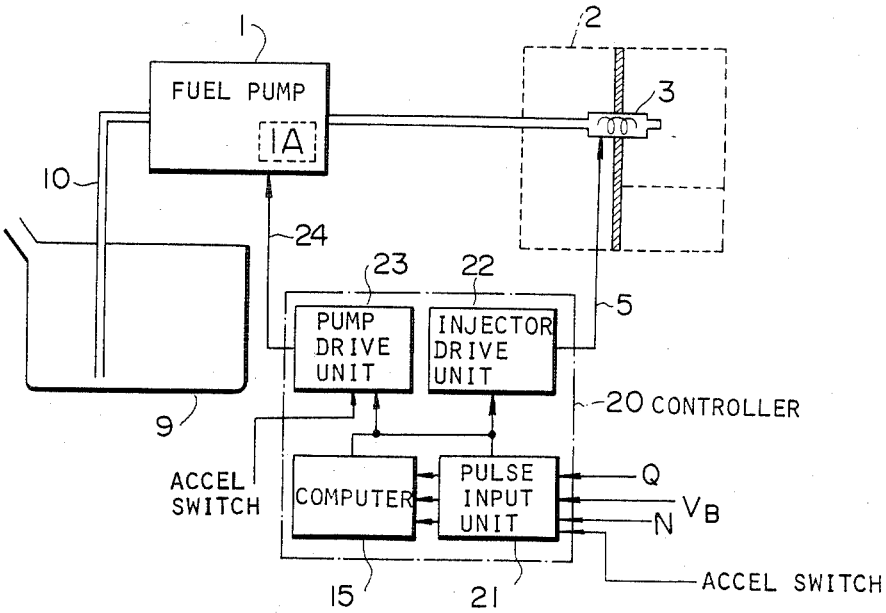
FIG. 2 is a schematic block diagram of a first preferred embodiment of the system for controlling fuel to be supplied from a motor-driven fuel pump to fuel injection valves for an engine according to the present invention.

In view of the above description, reference is now made to FIGS. 2–11, and more specifically to FIG. 2, in which there is illustrated a first preferred embodiment of the system for controlling fuel to be supplied from a motor-driven fuel pump to a fuel injection valve according to the present invention.

In FIG. 2, the system for controlling fuel to be supplied to fuel injection valves for an engine according to the present invention comprises a controller 20 in place of the prior-art control unit 4 shown in FIG. 1, in addition to the fuel pump 1, the fuel injection valves 3, and the fuel tank 9. The controller 20 includes a input unit 21, an injector drive unit 22 and a pump drive unit 23, which are all connected to a microcomputer 15.

Signals representative of various engine operating conditions, for example, intake air flow rate Q, battery voltage $V_B$ and engine speed N are inputted to the input unit 21. And, in accordance with these inputted signals representative of engine operating conditions, the pulse width of a signal to open the fuel injection valve 3 for an appropriate period of time is calculated by the microcomputer 15 and is outputted through the injector drive unit 22, and also the duty cycle of another signal to drive the motor for the fuel pump 1 so as to supply an appropriate level of pressure to the fuel injection valve for the engine is calculated by the microcomputer 15 and is outputted through the pump drive unit 23.

Now, follows a more detailed description of the controller 20 with reference to FIGS. 3 to 7.

Figure 3:
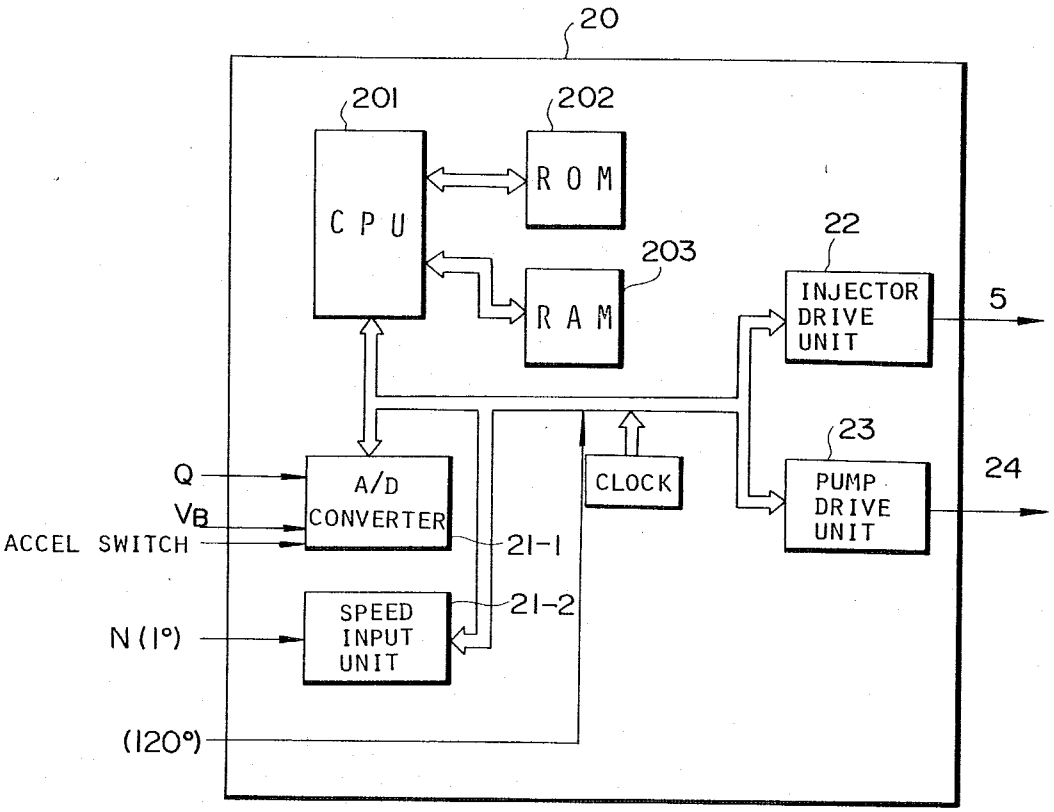
FIG. 3 is a schematic block diagram of a controller shown in FIG. 2.

FIG. 3 shows a schematic block diagram of a controller 20 of FIG. 2. The controller 20 comprises a microcomputer 15 having a CPU (central processing unit) 201 to execute various arithmetic operations in accordance with programs, a ROM (read only memory) 202 to store necessary programs thereinto, a RAM (random access memory) 203 in which to store various calculated results during execution of necessary arithmetical operations, and a clock which provides a high-frequency clock pulse signal for timing. The input unit 21 comprises, in this embodiment, an A-D converter 21-1 to convert analog signals of intake air flow rate Q and battery voltage $V_B$ to corresponding digital signals, and a speed input unit 21-2 to which engine speed N is inputted. The air flow rate Q and engine speed N are provided as electrical signals from conventional sensors (not shown). The speed sensor is constructed to generate a pulse signal at predetermined angular revolutions of the engine crankshaft. A first pulse train is produced at 1° intervals of crankshaft revolution, and these signals serve as engine speed signals. A second pulse train is produced at 120° intervals (six cylinder engine), and these signals serve as reference pulses for the fuel injection and ignition systems. Additionally, as shown in FIG. 3, the controller 20 comprises an injector drive unit 22 to output a signal to open the fuel injection valve 3 for an appropriate period of time and a pump drive unit 23 to output a signal to drive the fuel pump so as to supply an appropriate level of pressure, in accordance with the engine operating conditions (such as Q and/or N).

Figure 4:
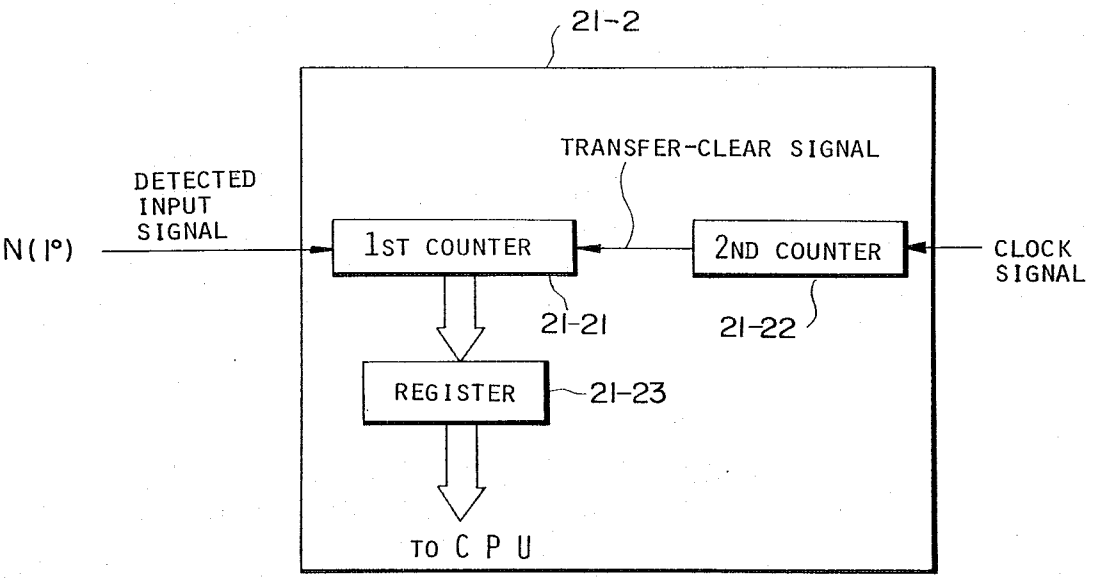
FIG. 4 is a schematic block diagram of a speed input unit shown in FIG. 3.

As shown in FIG. 4, the speed input unit 21-2 includes a first counter 21-21, a second counter 21-22 and a register 21-23. The second counter 21-22 counts the pulses of the clock pulse signal inputted thereto and when the pulse count reaches a value representing a predetermined engine speed sample interval, for instance, one second, the second counter 21-22 sends a transfer-clear signal to the first counter 21-21. In response to the transfer-clear signal, the first counter transfers the value of its current count to the register 21-23, and begins to count pulses of a signal inputted thereto, such as a detected engine speed signal N (for example, every 1°), and continues to count the inputted pulses until the next transfer-clear signal. Thus the first counter inputs to register 21-23 a value representing engine speed averaged over a short, predetermined sample interval. The register 21-23 is connected to the CPU 201 of the controller 20 in order to input its current value thereto.

When signals indicative of intake air flow rate Q, engine speed N, and battery voltage $V_B$ are inputted to the CPU 201 through the A/D converter 21-1 and the speed input unit 21-2, the CPU calculates a basic pulse signal used to open the fuel injection valve 3 for an appropriate period of time on the basis of predetermined arithmetic operation and a correction signal according to the battery voltage $V_B$, and adds the two signals. The resultant signal is then inputted to the injector drive unit 22 in order to open the fuel injection valve for the appropriate period of time.

In more detail, a basic pulse width according to the basic injection period is determined by the CPU 201 in accordance with the signal applied from the input unit 21. However, since there exists a time lag between the time when a signal is passed to the injection valve 3 and the time when the injection valve begins to actually inject fuel and since the time lag changes according to the voltage $V_B$ applied to the injection valve 3, a pulse width correction signal is calculated on the basis of the voltage $V_B$. The above two signals of the basic pulse width and the correction pulse width are added therein and applied to the injection drive unit 22 to output a pulse signal to drive the injection valve 3. In this manner, a pulse signal corresponding to an appropriate amount of fuel determined by the injector drive unit 22 is applied to the injection valve 3, and the fuel is directly injected into the intake manifold 7 or the engine.

Figure 5:
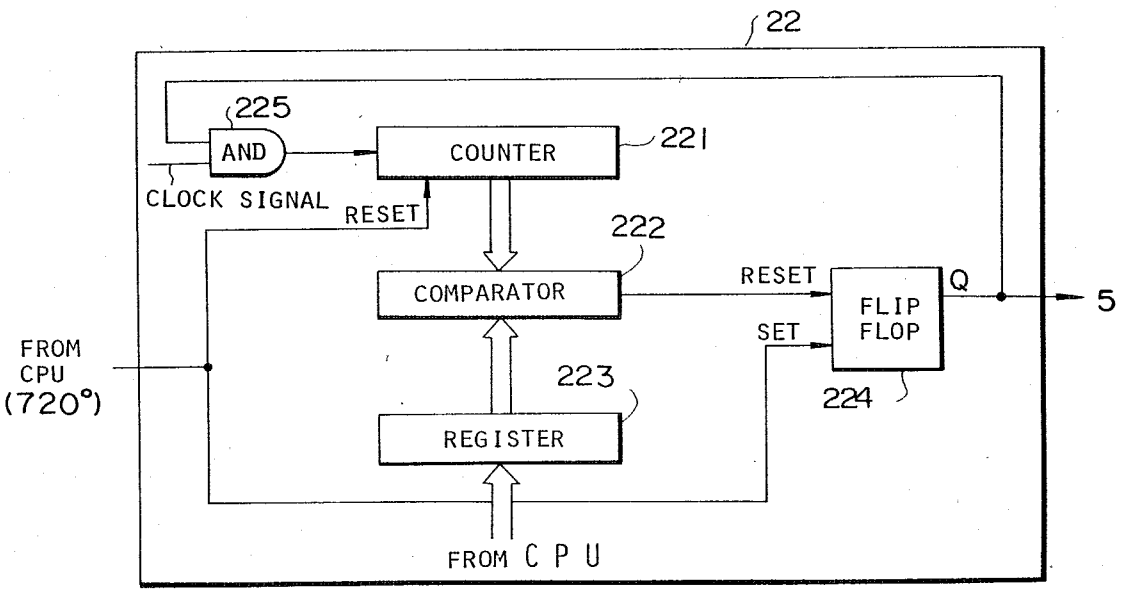
FIG. 5 is a schematic block diagram of an injector drive unit shown in FIG. 2.

As shown in FIG. 5, the injector drive unit 22 for one engine cylinder and comprises a counter 221, a comparator 222, a register 223, a flip-flop 224, and an AND gate 225.

An engine reference signal, every 720° for example, is generated by the CPU using the crankshaft 120° reference pulse train. When the reference signal is received, the counter 221 is cleared (or reset) and the flip-flop 224 is set, that is, the output of the flip-flop is turned to high level. The clock pulse signal is inputted to the AND gate 225, and when the output of the flip-flop is in high level, the AND gate is opened, thus the counter 221 receives and begins to count the clock pulses. The counted result is compared with the value in the register 223 in which the data representative of an appropriate pulse width calculated by the microcomputer in accordance with the engine operating conditions has been transferred from the CPU. Therefore, when the counted result coincides with the value in the register 223, the comparator 222 outputs a reset signal to the flip-flop 224 to turn the output thereof to a low level. Accordingly, the output of the AND gate 225 turns also to low level and thus no clock pulses are fed to the counter 221. That is to say, the injector drive unit 22 generates a pulse signal from the flip-flop with an appropriate pulse width according to the value determined by the microcomputer.

On the other hand signal indicative of intake air flow rate Q and accelerator pedal depression are inputted to the CPU 201 through the A/D converter 21-1, and the CPU calculates a basic pump motor power duty cycle for driving the fuel pump motor sufficiently to maintain the required fuel pressure. This calculated valve is applied to the pump drive unit 23 and the pump drive unit 23 supplies an output signal of sufficient power to the motor 1A of the fuel pump 1 through a signal wire 24.

In addition, in this case, it is also possible to adjust the voltage level of the pump driver output signal by using the CPU. The accelerator pedal is provided with a switch which is actuated when the accelerator pedal is depressed to within a range near the full-acceleration position, that is, whenever high acceleration is required. The signal from the accelerator switch inputted to the CPU 201 through the input unit 21 causes the voltage level of high-level duty cycle pulses to the fuel pump motor 1A to increase. The accelerator switch may provide either an analog or digital signal. In the embodiment of FIG. 3 it is assumed to be analog, but only one bit position need be interrogated by the CPU after A/D conversion since the needed information corresponds to a full-acceleration position wherein a most significant bit is set. Alternately, a simple threshold circuit may be utilized to provide a digit yes/no indication to the CPU.

Figure 6:
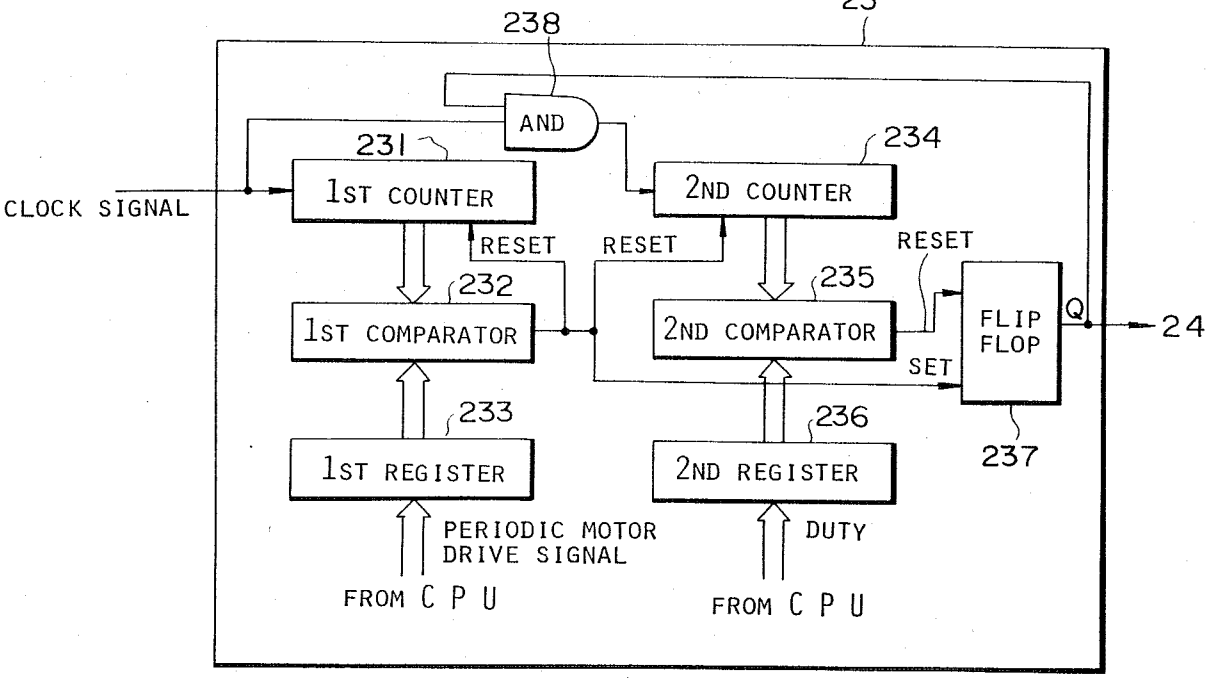
FIG. 6 is a schematic block diagram of a pump shown in FIG. 2.

As shown in FIG. 6, the pump drive unit 23 comprises a first circuit including a first counter 231, a first comparator 232, and a first register 233, a second circuit similar to the first one including a second counter 234, a second comparator 235 and a second register 236, a flip-flop 237, and an AND gate 238, the operations of which are similar to those in the injector drive unit 22.

The first register 233 is connected to the CPU to receive a digital signal therefrom indicative of the basic drive cycle signal of the pump motor. The basic drive cycle-signal represents the period of the duty cycle pulse used to control the pump motor. The first counter 231 counts clock pulses continuously, and the first comparator 232 compares the pulse count to the value in the first register 233. When the pulse count reaches the register value, the first comparator 232 outputs a signal to reset the first and second counters (231 and 234 respectively) to zero and to set the flip-flop 237 to a high-voltage level.

The output of the flip-flop 237 is used both as pump drive signal and as one input of the AND gate 238. When the flip-flop 237 is set, the AND gate 238 is opened so that the second counter 234, previously reset to zero by the first comparator 232, starts counting clock pulses inputted thereto via the AND gate 238. The second register 236 is connected to the CPU to receive therefrom a digital signal indicative of the duty cycle of the fuel pump 1 with respect to the start timing of the basic motor drive cycle signal inputted to the first register 233. The second comparator 235 compares the pulse count of the second counter 234 with the value in the second register 236, and when the former reaches the value of the latter, the second comparator 235 outputs a reset signal to the flip-flop 237. Thereby, the flip-flop 237 is reset to a low-voltage level, and consequently the AND gate 238 is closed and the fuel pump motor 1A is turned off until the flip-flop 237 is again set by the output of the first comparator 232. The ratio of the contents of register 236 to the contents of register 233 represents the pump motor duty cycle.

Figure 7:
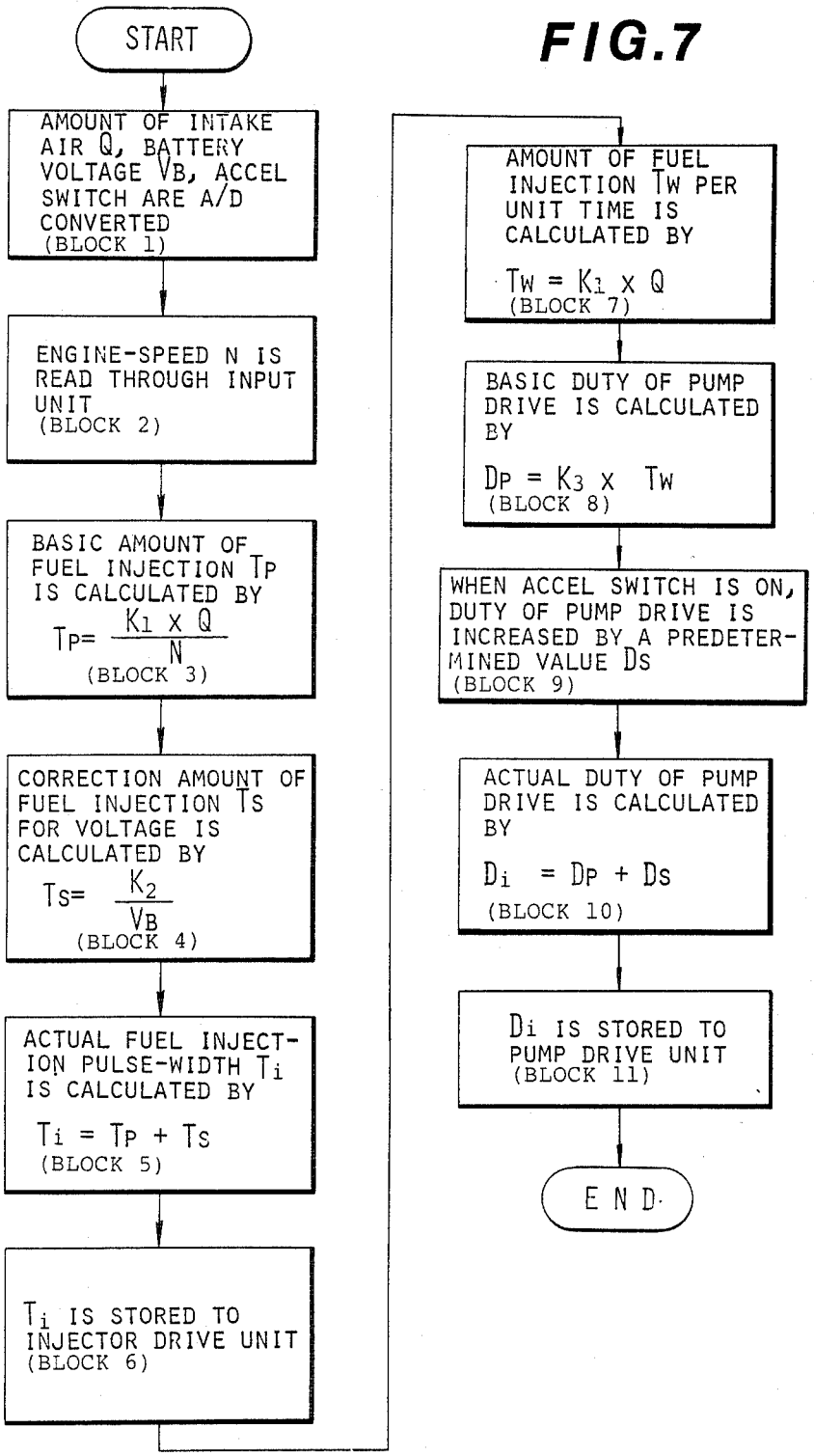
FIG. 7 is a flowchart illustrating the operation steps to control fuel to be supplied from a motor-driven fuel pump, which are executed through the controller including a microcomputer shown in FIG. 3.

The following is a description of the flowchart of the steps of the method for controlling fuel to be supplied from a motor-driven fuel pump to the fuel injection valve, with reference to FIG. 7.

First, the amount of intake air Q, the battery voltage $V_B$ and the accelerator switch position are converted from analog to digital signals through the A-D converter 21-1 in the input unit 21 (Block 1). Next, engine speed N is counted by the first counter 21-21 and stored into the register 21-23 within the speed input unit 21-2. The CPU calculates the basic amount Tp of fuel to be injected on the basis of expression $Tp=K_1\times Q/N$, where $K_1$ is a first constant (Block 3). Additionally, since the higher the voltage to drive the fuel injection valve, the faster the response of the valve, the CPU calculates the correction value Ts corresponding to the degree of battery voltage $V_B$ on the basis of expression $Ts=K_2/V_B$, where $K_2$ is a second constant (Block 4). After these arithmetic operations, a pulse width Ti of the signal to be applied to the fuel injection valve 3 is calculated on the basis of expression $Ti=Tp+Ts$ (Block 5). The data representative of pulse width Ti of fuel injection thus calculated by the CPU are next stored into the register 223 of the injector drive unit 22 (Block 6).

Next, the CPU calculates the amount Tw of fuel to be injected per unit time on the basis of expression $Tw=K_1\times Q$, where $K_1$ is the first constant (Block 7).

Further, since the level of fuel pressure to be generated by the fuel pump is proportional to the amount Tw of fuel per unit time to be injected through the fuel injection valve, the CPU calculates the duty cycle of the fuel pump motor on the basis of expression $D_p=K_3\times Tw$, where $K_3$ is a third constant (Block 8). When the accelerator switch is on, the CPU determines the correction value Ds to increase the duty of pump drive by a predetermined value (Block 9). After these arithmetic operations, an actual duty of pump drive Di of the signal to be applied to the pump drive unit 23 is calculated on the basis of expression $Di=Dp+Ds$ (Block 10). The data representative of start timing and duty cycle Di of the motor to drive the fuel pump thus calculated by the CPU are next stored into the first and second registers 233 and 236, respectively, of the pump drive unit 23 (Block 11).

Since the fuel control system is thus constructed, depending on the engine operating conditions obtained by the input unit 21 of the control unit 20, the injector drive unit 22 calculates a pulse width to open and close the fuel injection valve 3 and thus controls the amount of fuel to be injected into the engine 2. At the same time, the pump drive unit 23 calculates a necessary output signal required to drive the fuel pump 1 and thus controls the level of fuel pressure to be generated by the fuel pump 1.

Therefore, the fuel injection valve 3 can inject the proper amount of fuel according to the engine operating conditions, and the level of fuel pressure according to the amount of fuel to be injected is supplied by the motor-driven fuel pump 1 to the fuel injection valve 3. Accordingly, the fuel pump 1 is driven only when necessary, thus resulting in economization of battery drainage and fuel consumption.

Now, follows other preferred embodiments of the present invention.

Figure 8:
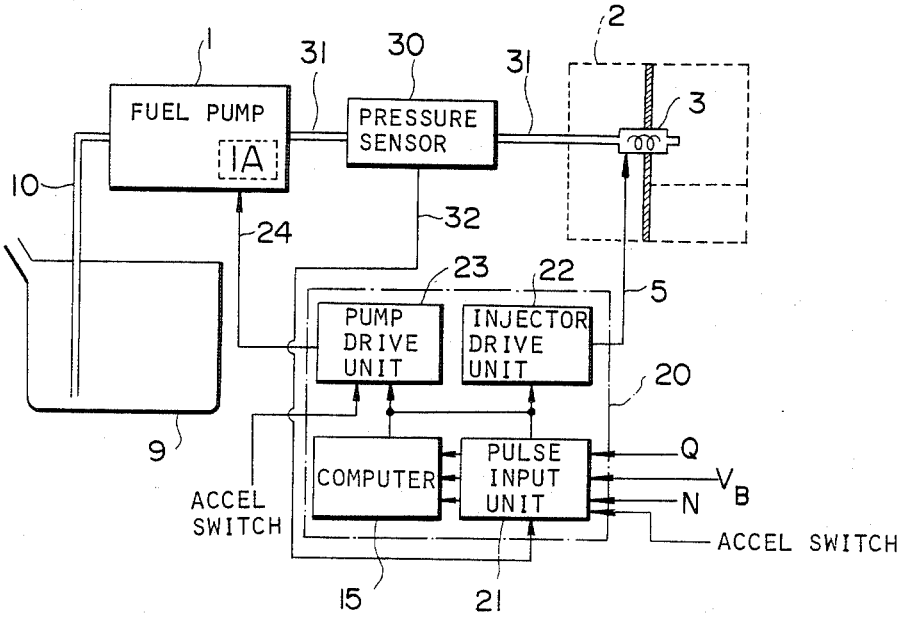
FIG. 8 is a schematic block diagram of a second preferred embodiment of the system for controlling fuel to be supplied from a motor-driven fuel pump to fuel injection valves for an engine according to the present invention, in which a pressure sensor is further included.

In a second preferred embodiment shown in FIG. 8, the reference numeral 30 denotes a pressure sensor disposed in a fuel-supply duct 31 communicating between the fuel pump 1 and the fuel injection valve 3 in order to detect the pressure of fuel supplied to the fuel injection valve 3. A signal indicative of fuel pressure detected by the sensor 30 is supplied to the input unit 21 through a signal wire 32.

Depending on the fuel pressure signal, the microcomputer 15 adjusts the duty cycle of the fuel pump motor 1A. Depending on the adjustment to the duty cycle DUTY, the output necessary to drive the pump is calculated, so that the pressure of fuel to be supplied to the fuel injection valve 3 is maintained at a constant level.

In this embodiment, after having been A-D converted through the input unit 21, the output of the pressure sensor 30 is used to adjust the third constant $K_3$ explained in Block 7 of FIG. 7, in order to correct the value of the duty cycle $D_p$ and therefore the fuel pressure.

Figure 9:
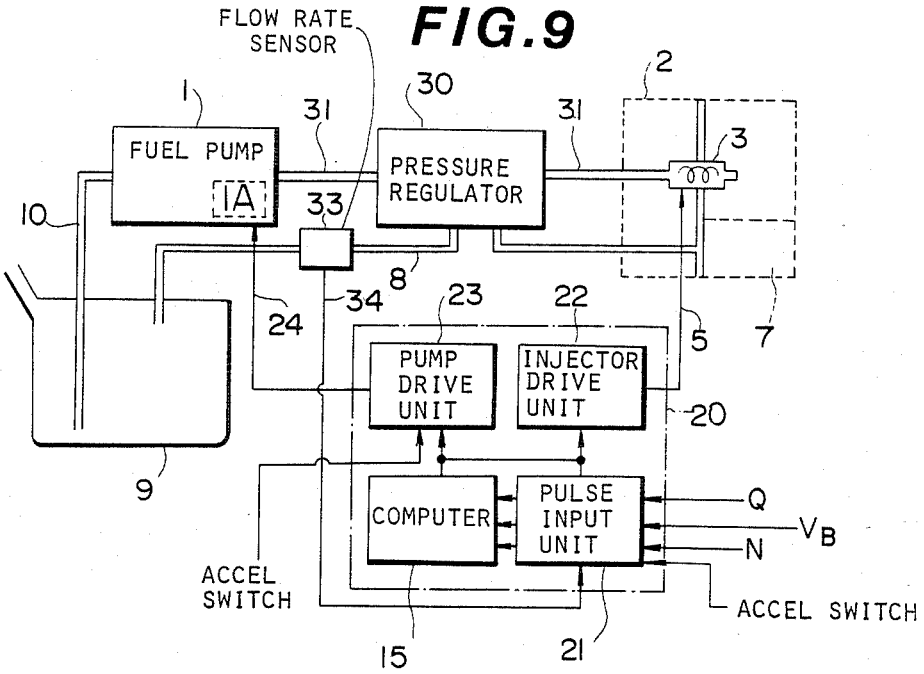
FIG. 9 is a schematic block diagram of a third preferred embodiment of the system for controlling fuel to be supplied from a motor-driven fuel pump to fuel injection valves for an engine according to the present invention, in which a pressure regulator and a flow-rate sensor are further included.

In a third preferred embodiment shown in FIG. 9, a pressure regulator 6 is disposed in the fuel supply duct 31. The reference numeral 33 denotes a flow-rate sensing means such as a flow-rate sensor disposed in the return pipe 8 used to return the fuel from the pressure regulator 6 to the fuel tank 9. The reference numeral 34 denotes a signal wire to feed-back a signal representative of the amount of flow detected by the flow-rate sensing means 33 to the input unit 21. In this embodiment, the pressure of fuel fed via the pressure regulator 6 from the fuel pump 1 to the fuel injection valve 3 is controlled in the same way as in prior art systems as previously described.

The fuel from the pressure regulator 6 is detected by a flow rate sensor 33 and a signal representative of this excess fuel is sent to the microcomputer 15 via the input unit 21. The microcomputer 15 adjusts the fuel pump duty cycle $D_p$ in accordance with the flow rate sensor signal, and supplies the adjusted $D_p$ signal to the second register 2336 of the pump drive unit 23. Thereby, a drive signal with an appropriate duty cycle is applied to the motor 1A of the fuel pump 1 to control the level of fuel pressure to be generated by the fuel pump 1. In this embodiment the method for controlling the fuel injection valve 3 is the same as in the preferred embodiments described hereinabove.

In more detail, in this embodiment, after having been A-D converted through the input unit 21, the output of the flow-rate sensor 33 is used to correct the third constant $K_3$ explained in Block 7 of FIG. 7 in such a way that when the amount of fuel returned to the fuel tank is great, $K_3$ is corrected to be smaller to decrease the fuel pressure, so that it is possible to control the fuel pressure accurately.

In the fuel control system thus constructed, since the operation of the fuel pump is controlled so that the amount of fuel to be returned from the pressure regulator 6 to the fuel tank 9 can be minimized while the pressure of fuel with respect to the intake manifold pressure is maintained at a constant level, it is possible to economize power consumption to a great degree.

Figure 10:
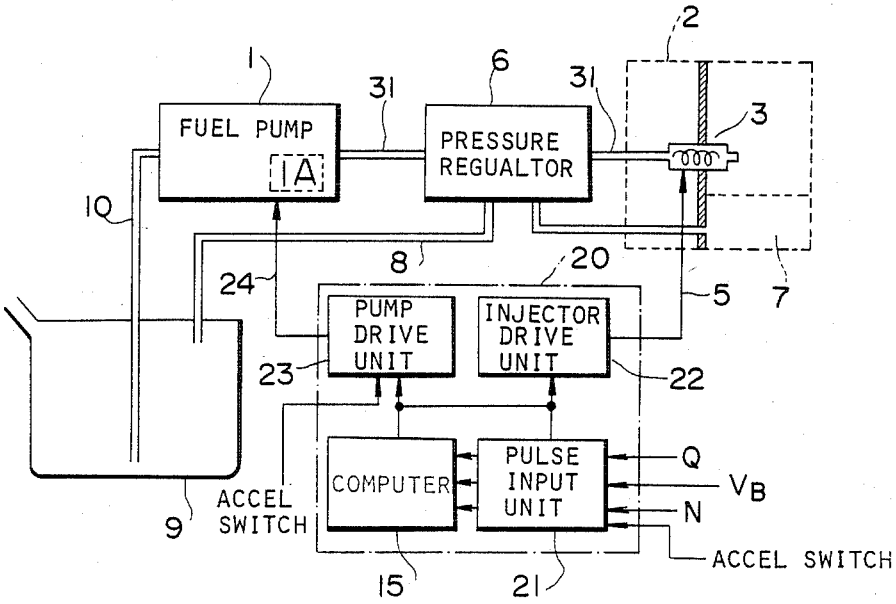
FIG. 10 is a schematic block diagram of a fourth preferred embodiment of the system for controlling fuel to be supplied from a motor-driven fuel pump to fuel injection valves for an engine according to the present invention, in which only the pressure regulator is included.

Furthermore, even if the fuel flow sensor 33 is omitted as shown in FIG. 10, it is possible to attain almost the same effect as described hereinabove. To explain in more detail, the level of fuel pressure to be generated by the pump 1 and the amount of fuel to be injected by the injection valve 3 are both previously determined according to the engine operating conditions, and the difference between the fuel pressure within the duct 31 and the intake manifold pressure is maintained at a roughly constant level. Therefore, since the amount of fuel to be returned from the regulator 6 to the tank 9 is very little, even if the sensor is omitted, it is possible to obtain almost the same effect, thus reducing the load applied to the alternator.

In the above-mentioned embodiments, the level of fuel pressure to be generated by the fuel pump 1 is controlled by changing the duty cycle of a signal applied to the motor 1A of the fuel pump 1, that is, by using the method of pulse width modulation at a frequency sufficiently higher than the response frequency of the fuel pump 1. However, it also possible to intermittently control the operation of the fuel pump 1 by supplying a drive signal intermittently to the motor 1A at a relatively low frequency.

Figure 11:
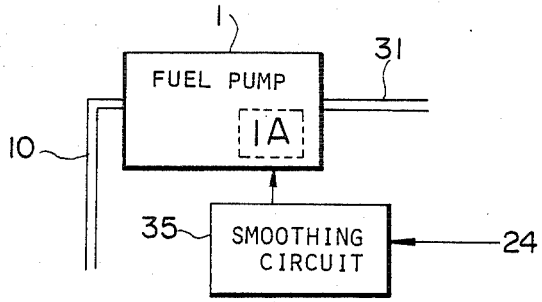
FIG. 11 is a schematic partial block diagram of a fifth preferred embodiment of the system for controlling fuel to be supplied from a motor-driven fuel pump to fuel injection valves for an engine according to the present invention, in which a DC amplifier and a D-A converter are further included.

Moreover, as shown in FIG. 11, it is possible to control the level of fuel pressure to be generated by the pump 1 by connecting a smoothing circuit between the pump drive unit 23 and the motor 1A.

In this embodiment, a pulse signal having an appropriate duty cycle obtained through the controller 20 as already described is averaged by the smoothing circuit 35 to produce an analog voltage signal, the voltage level of which corresponds to the duty cycle of the signal 24. The analog signal from the smoothing circuit drives the fuel pump motor continuously at only the power level necessary to maintain the required fuel pressure. The resultant continuous-drive characteristic will reduce wear-and-tear on the motor 1A and the automotive electrical system due to surging and switching in response to pulse signal 24.

As described above, according to the present invention, since the amount of fuel to be injected through the fuel injection valve is controlled according to the engine operating conditions in addition to controlling the level of fuel pressure to be generated by the fuel pump 1, it is possible to drive the motor used for operating the fuel pump only when necessary, thus reducing the power consumption rate, the load applied to the battery and alternator, and generally improving the fuel consumption rate.

In addition, in the description above, engine speed and intake air flow rate are discussed as examples of engine operating conditions to be inputted to the controller. However, the scope of the invention is not limited to these information data, and it is of course possible to control the level of fuel pressure generated by the fuel pump by inputting into the controller at least one information data of other engine operating conditions including, for instance, intake air vacuum, etc.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A controller for controlling fuel supplied by a fuel pump driven by a fuel pump motor to a fuel injection valve of an engine, comprising:

(a) a plurality of sensors for detecting engine operating conditions and for generating sensor signals corresponding thereto;

(b) an input unit responsive to the sensor signals for providing digital output signals corresponding thereto;

(c) a microcomputer connected to said input unit for receiving said digital output signals, said microcomputer being operable to calculate a basic fuel injection time period during which said fuel injection valve injects fuel into the engine and a basic motor-drive duty cycle for driving the fuel pump motor to supply fuel from the fuel pump to the fuel injection valve in accordance with the digital output signals;

(d) an injector drive unit connected to said microcomputer for outputting a pulse signal to the fuel injection valve, said pulse signal having a pulse width corresponding to the basic fuel injection time period calculated by said microcomputer; and (e) a pump drive unit connected to said microcomputer for outputting a pulse signal to said fuel pump motor having a duty cycle corresponding to the basic motor-drive duty cycle calculated by said microcomputer;

wherein said basic fuel injection time period and said basic motor drive duty cycle correspond such that the amount of fuel pumped from the fuel pump matches the amount of fuel injected by the injector; and wherein said microcomputer generates clock pulses and said pump drive unit comprises:

(1) a first counter for counting the number of said clock pulses inputted thereto;

(2) a first register connected to said microcomputer for storing a first data calculated by said microcomputer, said first data being representative of the period of said pulse signal from the pump drive unit;

(3) a first comparator for comparing the number of clock pulses counted by said first counter with the first data stored in said first register and for outputting a set signal when the counted number is equal to the first data stored in said first register;

(4) a second counter for counting the number of clock pulses inputted thereto;

(5) a second register connected to said microcomputer for storing the basic motor-drive duty cycle calculated by said microcomputer;

(6) a second comparator connected to said second counter and second register for comparing the number of clock pulses of said second counter with the basic motor-drive duty cycle stored in said second register and for outputting a reset signal when the counted number of clock pulses reaches the basic motor-drive duty cycle stored in said second register;

(7) a flip flop for outputting said pulse signal of said pump drive unit, the flip flop output being set to a first level when said first comparator outputs the set signal thereto and being reset to a second level when said second comparator outputs the reset signal thereto; and (8) an AND circuit for outputting the clock pulses to said second counter only while the flip-flop output is at said first level.

2. A controller for controlling fuel supplied by a fuel pump driven by a fuel pump motor to a fuel injection valve of an engine, comprising:

(a) a plurality of sensors for detecting engine operating conditions and for generating sensor signals corresponding thereto;

(b) an input unit responsive to the sensor signals for providing digital output signals corresponding thereto;

(c) a microcomputer connected to said input unit for receiving said digital output signals, said microcomputer being operable to calculate a basic fuel injection time period during which said fuel injection valve injects fuel into the engine and a basic motor-drive duty cycle for driving the fuel pump motor to supply fuel from the fuel pump to the fuel injection valve in accordance with the digital output signals;

(d) an injector drive unit connected to said microcomputer for outputting a pulse signal to the fuel injection valve, said pulse signal having a pulse width corresponding to the basic fuel injection time period calculated by said microcomputer; and (e) a pump drive unit connected to said microcomputer for outputting a pulse signal to said fuel pump motor having a duty cycle corresponding to the basic motor-drive duty cycle calculated by said microcomputer;

wherein said basic fuel injection time period and said basic motor drive duty cycle correspond such that the amount of fuel pumped from the fuel pump matches the amount of fuel injected by the injector; and wherein said microcomputer generates clock pulses and one of said sensors generates a first pulse signal comprising a train of pulses at predetermined intervals of crankshaft rotation and wherein said input unit comprises:

(a) a first counter for counting pulses of said train of pulses;

(b) a second counter for generating a transfer-clear signal to said first counter to determine a predetermined pulse count time interval for said first counter, a said second counter counting a predetermined number of clock pulses corresponding to said time interval, and (c) a register connected to said first counter for storing the counted number of pulses from said first counter and outputting said number to said microcomputer, said number of pulses in said register comprising an engine speed signal.

* * * * *